US005384013A

United States Patent [19]

Husband et al.

[11] Patent Number: 5,384,013

[45] Date of Patent: Jan. 24, 1995

[54] CATIONIC PIGMENT-CONTAINING PAPER COATING COMPOSITION

[75] Inventors: John C. Husband; Richard Bown, both of St. Austell; Pamela G. Drage, Par, all of Great Britain

[73] Assignee: ECC International Limited, United Kingdom

[21] Appl. No.: 853,757

[22] Filed: Jun. 4, 1992

Related U.S. Application Data

[63] Continuation-in-part of Ser. No. 613,447, Nov. 13, 1990, abandoned, which is a continuation of Ser. No. 398,289, Aug. 22, 1989, abandoned, which is a continuation of Ser. No. 146,961, Jan. 22, 1988, abandoned.

[30] Foreign Application Priority Data

Dec. 6, 1989 [GB] United Kingdom ..... 8927536

[51] Int. Cl.[6] ..... D21H 17/69

[52] U.S. Cl. ..... 162/168.1; 162/181.1; 162/181.3; 162/168.3; 162/164.1; 162/164.6; 106/436; 106/437; 106/465; 106/469

[58] Field of Search ..... 162/135, 181.1, 181.3, 162/168.1, 168.3, 164.1, 164.6; 106/499, 436, 437, 465, 469

[56] References Cited

U.S. PATENT DOCUMENTS 4,772,332 9/1988 Nemeh et al. ..... 106/503
4,775,420 10/1988 Gonnet et al. ..... 106/465
5,152,835 10/1992 Nemeh ..... 106/436

FOREIGN PATENT DOCUMENTS 0278602 8/1988 European Pat. Off. .
0307795 3/1989 European Pat. Off. .
3707221 9/1989 Germany .

OTHER PUBLICATIONS

"Improved Cationic Conductive Polymer Displays Outstanding Filmability", A. J. Sharpe, Jr. et al., TAPPI, Apr. 1982, vol. 65, No. 4, pp. 123-125.

*Primary Examiner*—W. Gary Jones
*Assistant Examiner*—Dean T. Nguyen
*Attorney, Agent, or Firm*—Klauber & Jackson

[57] ABSTRACT

There is disclosed an aqueous paper coating composition which comprises at least 45% by weight of a particulate pigment dispersed with a dispersing agent, and an adhesive; characterized in that said dispersing agent comprises an anionic polyelectrolyte and a cationic polyelectrolyte, the cationic polyelectrolyte being present in an amount sufficient to render the particles cationic, in that said adhesive is a cationic or non-ionic adhesive and in that said particulate pigment is one which is not capable of being dispersed in water at high solids, and following vigorous mixing, in the sole presence of said cationic polyelectrolyte. Also disclosed is a method for making the paper coating composition, a method for coating a paper with a paper coating composition and the resulting coated paper. The coated paper of the invention is particularly suited to recycling.

19 Claims, No Drawings

CATIONIC PIGMENT-CONTAINING PAPER COATING COMPOSITION

This application is a continuation-in-part of application Ser. No. 613,447, filed Nov. 13, 1990 abandoned, which is a continuation of Ser. No. 398,289 filed Aug. 22, 1989 abandoned, which is a continuation of Ser. No. 146,961 filed Jan. 22, 1988 abandoned.

This invention relates to a paper coating composition, a method for preparing a paper coating composition, a method for coating a paper with a paper coating composition and coated paper. This invention also relates to a paper recycling process in which a coated paper of the invention is employed as "broke" in a paper making process. "Broke" is the term used in the art for paper, cardboard, or the like which is to be recycled.

Calcium carbonate is known as a paper coating pigment and, because it normally carries a positive charge, it is conventionally dispersed with an anionic dispersing agent. Other paper coating pigments which carry a neutral or positive charge exist, such as gypsum, talc, calcined kaolin clay, and these must also be dispersed using an anionic dispersing agent. (These minerals are also recognised as having a deficiency in negative sites).

A full discussion of the constituents of paper coating compositions and of the methods of applying such compositions to paper is given in Chapter XIX, Volume III of the second edition of the book by James P. Casey entitled "Pulp and Paper: Chemistry and Technology". A further discussion is given in "An Operator's Guide to aqueous Coating for Paper and Board", edited by T. W. R. Dean, The British Paper and Board Industry Federation, London, 1979.

DE-3707221 and EP-0307795 disclose a cationic pigment dispersion. The pigment is first given a protective colloid cover using a cationised polymer and then, under certain circumstances, is dispersed with a cationic polymer.

TAPPI, vol. 65, no. 4, April 1982, pages 123–125, Atlanta, Ga., U.S.A.; A. J. Sharpe, Jr. et al.: "Improved Cationic Conductive Polymer Displays Outstanding Filmability" describes a polysalt formed from the interaction of a strongly cationic polymer, such as a poly(diallyl dimethyl ammonium chloride), and a weakly anionic polymer, such as polyacrylic acid. The thus-formed polysalt is added in substantial quantities (of the order of 50% by weight, based on the weight of the pigment) to a predispersed, low solids pigment slurry in order to provide a conductive coating colour which is used to prepare a paper having a conductive surface.

According to a first aspect of the present invention there is provided an aqueous paper coating composition which comprises (i) at least 45% by weight of a particulate inorganic pigment dispersed with a dispersing agent and (ii) an adhesive; characterised in that said dispersing agent comprises an anionic polyelectrolyte and a cationic polyelectrolye, the cationic polyelectrolyte being present in an amount sufficient to render the particles cationic; in that said adhesive is a cationic or non-ionic adhesive; and in that said particulate pigment is one which is not capable of being dispersed in water at high solids, and following vigorous mixing, in the sole presence of said cationic polyeletrolyte.

According to a second aspect of the present invention there is provided a method of coating a sheet member comprising the step of coating the sheet member with a paper coating composition in accordance with the first aspect of this invention.

According to a third aspect of the present invention, there is provided a coated paper produced by the method of the second aspect of this invention. This paper may advantageously be recycled in a paper making process.

The particulate pigment used in the present invention is one which is not capable of being dispersed in water at high solids (such as greater than by weight) and following vigorous mixing, (for example sufficient to dissipate at least 10kJ of energy per kg of dry pigment), in the sole presence of the cationic polyelectrolyte. This means that the pigment surface should have a neutral, or overall positive, charge. This is true of inorganic pigments such as calcium carbonate, calcium sulphate, talc and calcined kaolin clay, for example. Most preferably, the pigment is calcium carbonate, in any form, natural or synthetic. Most preferred is ground or crushed marble, but chalk, or precipitated calcium carbonate (PCC) may also be used. In this respect, it should be noted that whilst raw chalk is capable of being dispersed using a cationic polyelectrolyte in the absence of vigorous mixing, this is not true if the chalk is subject to vigorous mixing. It is believed that this is because the vigorous mixing strips off the anionic aluminosiliceous layer normally present on raw chalk. In the absence of vigorous mixing, the aluminosiliceous layer is able to confer a negative charge on the surface of the chalk particles and this enables dispersion by a cationic polyelectrolyte to be achieved.

It is preferred that the ground pigment has a particle size distribution such that at least 50% percent by weight has an equivalent spherical diameter smaller than two microns. More preferably, at least 60% percent by weight has an equivalent spherical diameter smaller than two microns.

Ground marble for use in the present invention is preferably formed by crushing batches of marble in aqueous suspension in the absence of a chemical dispersing agent using a particulate grinding medium. Any agglomerates formed may be broken up by dewatering the suspension of ground marble, for example by filtration in the absence of a flocculating agent and then drying the pigment, and pulverising the dried product in a conventional mill.

The particulate pigment is dispersed with the combination of an anionic polyelectrolyte and a cationic polyelectrolyte. Preferably, the anionic polyeletrolyte is a water-soluble vinyl polymer, an alkali metal or ammonium salt thereof or an alkali metal or ammonium salt of polysilicic acid. Most preferably, the anionic polyeletrolyte is a poly(acrylic acid), a poly(methacrylic acid), a substituted poly(acrylic acid) or a substituted poly(-methacrylic acid), or an alkali metal or ammonium salt of any of these acids. The substituted poly(acrylic acid) may be a partially sulphonated polymer. An especially effective anionic polyelectrolyte is an alkali metal or ammonium salt of a copolymer of acrylic acid and a sulphonic acid derivative of acrylic acid, in which the proportion of the sulphonic acid derivative monomer is preferably from 5% to 20% of the total number of monomer units.

The number average molecular weight of the anionic polyelectrolyte is preferably at least 500, and preferably no greater than 100,000. The amount used is generally in the range of from about 0.01% to about 0.5% by weight based on the weight of dry pigment, preferably in the range of from about 0.1 to 0.2% by weight.

The cationic polyelectrolyte may be a watersoluble substituted polyolefine containing quaternary ammonium groups. The quaternary ammonium groups may be in the linear polymer chain or may be in branches of the polymer chain. The number average molecular weight of the substituted polyolefine is preferably at least 1500 and preferably no greater than 1,000,000, and is more preferably in the range of from 50,000 to 500,000. The quantity required is generally in the range of from about 0.01% to about 1.5% by weight based on the weight of dry pigment. Advantageous results have been obtained when the substituted polyolefine is a poly (diallyl di(hydrogen or lower alkyl)ammonium salt). The lower alkyl groups, which may be the same or different, may for example, have up to four carbon atoms and each is preferably methyl. The ammonium salt may be, for example, a chloride, bromide, iodide, $HSO_4^-$, $CH_3SO_4^-$ or nitrite. Preferably the salt is a chloride. Most preferably, the cationic polyelectrolyte is poly (diallyl dimethyl ammonium chloride). Alternatively, the water-soluble substituted polyolefin may be the product of co-polymerising epichlorohydrin and an aliphatic secondary amine, said product having the formula

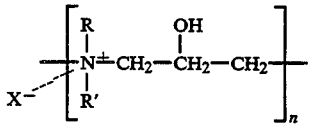

in which R and R', which may be the same of different, are each hydrogen or a lower alkyl group having from one to four carbon atoms, preferably methyl or ethyl and X is $Cl^-$, $Br^-$, $I^-$, $HSO_4^-$, $CH_3SO_4^-$ or nitrite. The preferred number average molecular weight of this epichlorohydrin product is in the range of from 50,000 to 300,000.

Alternatively, the cationic polyelectrolyte may be a water-soluble organic compound having a plurality of basic groups and preferably having a number average molecular weight of at least 10,000 and preferably no greater than 1,000,000. Most preferably, the number average molecular weight is at least 50,000. These water-soluble organic compounds may be described as polyacidic organic bases, and are preferably compounds of carbon, hydrogen and nitrogen only and are free of other functional groups, such as hydroxy or carboxylic acid groups, which would increase their solubility in water and thus increase the likelihood of their being desorbed from the clay mineral in an aqueous suspension. Preferably, the organic compound is polyethyleneimine (PEI) having a number average molecular weight in the range 50,000 to 1,000,000. A further example of a water-soluble organic compound which may be employed is a polyethylene diamine which may be a copolymer of ethylene diamine with an ethylene dihalide or with formaldehyde.

The cationic polyelectrolyte is employed in an amount sufficient to render the mineral particles cationic. Experiments have shown that the zeta potential of the particles will normally be at least +20 mV after treatment, typically in the range of from +30 to +40 mV and usually no greater than +50 to +60 mV. These potentials have been measured using a dilute (0.02 weight %) solids suspension using a supporting electrolyte of potassium chloride ($10^{-4}$M) with a "Pen Kem Laser Z" meter.

The ratio of the weight of cationic polyelectrolyte to the weight of anionic polyelectrolyte used is preferably in the range of from 2:1 to 20:1, in particular when the calcium carbonate is a ground marble.

According to a fourth aspect of the present invention, there is provided a process for preparing a paper coating composition comprising the steps of:

(i) dispersing in aqueous suspension a particulate pigment; and (ii) combining the dispersed aqueous suspension with an adhesive and, if necessary, adjusting the dilution such that the particulate material constitutes at least 45% by weight of the composition;

characterised in that said pigment is dispersed using a dispersing agent comprising a combination of an anionic polyelectrolyte and a cationic polyelectrolyte; in that said cationic polyelectrolyte is used in an amount sufficient to render the pigment particles cationic; in that said adhesive is a cationic or non-ionic adhesive; and in that said particulate pigment is one which is not capable of being dispersed in water at high solids, and following vigorous mixing, in the sole presence of said cationic polyeletrolyte.

In the method of the invention, it is normally the case that the raw pigment is received as a filter cake having a relatively high solids content. To this is added the dispersing agent in order to provide a dispersed high solids slurry (45–80% by weight solids) which may then be subjected to vigorous mixing. This slurry is then "made down" into a paper coating composition by dilution and addition of the required quantity of the cationic or non-ionic adhesive and other conventional paper coating composition adjuvants.

Preferably, the pigment is mixed with the anionic polyeletrolyte before mixing with the cationic polyelectrolyte. This appears to enable a more fluid suspension to be obtained at a higher solids concentration.

The aqueous dispersion of the pigment may also include other conventional paper coating composition adjuvants such as an insolubilising agent (e.g. a melamine formaldehyde resin), a lubricant such as calcium stearate and a catalyst to catalyze cross-linking of the cationic latex if present: a suitable such catalyst is sodium bicarbonate. The quantities of these adjuvants required are known to those skilled in the art.

The adhesive used in the present invention should be a non-ionic or a cationic adhesive. Such adhesives contrast with the anionic adhesives which are normally used in paper coating compositions in which the pigment is anionic. Thus, cationic guar gum and cationic starch adhesives can be used as well as cationic or non-ionic latices. Such cationic and non-ionic adhesives are readily commercially available. The particular cationic or non-ionic adhesive used will depend, for example, on the printing process to be used, e.g. offset lythography requires the adhesive to be water-insoluble. For paper to be used in an offset printing technique, the amount of adhesive should preferably be of the order of from 7 to 25% by weight, based on the weight of pigment whilst, for gravure printing paper, the adhesive should be used in an amount of 4–15% by weight, based on the weight of pigment. The precise quantity of adhesive required will depend upon the nature of the adhesive and the material being coated, but this can readily be determined by the person skilled in the art.

The suspension of the pigment for incorporation into the paper coating composition of the present invention should preferably be subjected to vigorous mixing before or after dispersion. Typically, the vigorous mixing should be sufficient to impart at least 10kJ energy per kg of pigment, and preferably no more than about 50kJ per kg. Normally, the amount of energy input will be in the range of from 18–36kJ per kg of pigment.

The coating composition may be coated on to a sheet member using normal paper coating machinery and under normal paper coating conditions. It has been found that the paper coated with a cationic composition in accordance with the present invention provides broadly similar results to that obtained with a conventional anionic system.

The coated paper of the present invention is of advantage when it is employed as "broke" or recycled paper in a paper making process. Commonly, large quantities of paper are recycled at the point of manufacture for one reason or another, and the advantages of the paper of the present invention in recycling are most important to the paper manufacturer. Thus, in accordance with a fifth aspect of the present invention, there is provided a method for recycling paper including the step of reducing paper in accordance with the third aspect of the present invention to a fibrous recyclable state and incorporating said fibre in a paper-making composition.

Such a paper-making composition may include conventional paper-making pulp, such as a bleached sulphite pulp and, typically, the broke fibre and the pulp will be employed in a ratio of from 10:90 to 60:40.

Also included in the paper making composition will be a filler, for instance a calcium carbonate filler and also a retention aid. Since the broke fibre will include a proportion of calcium carbonate from the coating, it is possible to reduce the amount of calcium carbonate filler employed to give a total quantity of filler in the range of from 5 to 20 percent by weight of the total paper-making composition. The weight of dried broke added (fibre and filler) should preferably be in the range of from about 5 to 30 percent by weight of fibre.

It has been found that, when the broke fibre employed is derived from a coated paper in accordance with the present invention, this enables the amount of retention aid employed in the paper making composition to be reduced.

The present invention will now be illustrated by the following examples:

EXAMPLE 1

Three batches of raw crushed marble were ground in an aqueous suspension containing 30% by weight of dry solids and in the absence of chemical dispersing agent, by means of a particulate grinding medium. The duration of grinding was different in each case so as to yield three different ground products having particle size distributions such that 50%, 68% and 87% by weight, respectively, had an equivalent spherical diameter smaller than 2 microns. In each case the suspension of ground marble was dewatered by filtration in a tube pressure filter in the absence of a flocculating agent and the filter cake was dried and pulverised in a laboratory hammer mill.

Samples of each of the three ground marble powders were mixed with water and with two different dispersing agents by each of two different methods described below. The dispersing agents were:

(E) an anionic polyelectrolyte which was a sodium polyacrylate having a number average molecular weight of 4,000; and (F) a cationic polyelectrolyte which was a poly (diallyl dimethyl ammonium chloride) having a number average molecular weight of 50,000.

In each case the ratio of weight of (F) to the weight of (E) was 4:1 but the optimum total quantity of dispersing agents were determined for each ground marble powder and was found to differ in each case. The two methods for preparing the aqueous suspension of the marble powders were:

(i) the powder was mixed with water containing the required quantity of (E) and after thorough mixing the required quantity of (F) was added, followed by further mixing; and (ii) the powder was mixed with water containing the required quantities of both (E) and (F) together.

In each case the viscosity of the suspension was measured by means of a Brookfield Viscometer at a spindle speed of 100 rpm. and the percentage by weight of dry solids was determined by completely drying a known weight of the suspension and weighing the dried residue. The suspension was then diluted with a small quantity of water and further determinations of viscosity and percentage by weight of dry solids were made. A graph was plotted of viscosity against percentage by weight of dry solids and the solids concentration for a suspension having a viscosity of 500 mPa.s was determined by interpolation.

The results obtained are set forth in Table I below:

TABLE 1

| % by wt. smaller than 2 microns in marble | % by wt. based on wt. of dry marble of | | % by wt. of dry solids for a viscosity of 500 mPa.s by method | |
|---|---|---|---|---|
| | (E) | (F) | (i) | (ii) |
| 50 | 0.02 | 0.083 | 72.0 | 71.3 |
| 68 | 0.075 | 0.289 | 71.4 | 65.6 |
| 87 | 0.166 | 0.65 | 64.6 | 60.3 |

These results show that fluid suspension can be obtained at a higher solids concentration by method (i) (mixing the powder firstly with the anionic polyelectrolyte and secondly with the cationic polyelectrolyte) than by method (ii) (mixing the powder with both dispersing agents together). This effect is more marked with finely ground marble powders than with a coarser product.

EXAMPLE 2

A further batch of finely ground marble powder was prepared by the process described in Example 1, the particle size distribution of the ground product being such that 87% by weight consisted of particles having an equivalent spherical diameter smaller than 2 microns.

Samples of this marble powder were incorporated into paper coating compositions prepared according to the following recipes:

| | Ingredient | Parts by weight |
|---|---|---|
| Composition (a) | Marble powder | 100 |
| | Quaternary cationic acrylic latex | 12 |
| | Cationic guar gum | 0.5 |
| Composition (b) | Marble powder | 100 |
| | Quaternary cationic | 8 |

-continued

| Ingredient | Parts by weight |
|---|---|
| acrylic latex | |
| Cationic starch | 4 |

Three different compositions of type (b) were prepared containing the following three different cationic starches:

(i) a cationic starch of low degree of substitution (ii) another cationic starch of low degree of substitution (iii) a cationic starch of high degree of substitution The three compositions were identified as compositions (b) ( i ), (b) ( ii ) and (b) ( iii ), respectively

| | Ingredient | Parts by weight |
|---|---|---|
| Composition (c) | Marble powder | 100 |
| | Styrene butadiene rubber latex | 12 |
| | Sodium carboxymethyl cellulose | 0.75 |
| Composition (d) | Marble powder | 100 |
| | Styrene butadiene rubber latex | 8 |
| | Oxidised starch | 4 |

In the case of the cationic compositions (a) and (b) an aqueous suspension of the marble powder was first prepared using as the dispersing agents 0.16% by weight, based on the weight of dry marble, of anionic dispersing agent (E) and 0.65% by weight, based on the weight of dry marble, of cationic dispersing agent (F), by the method described under (i) in Example 1 above.

In the case of the anionic compositions (c) and (d) the marble powder was treated with 0.30% by weight, based on the weight of dry marble, of dispersing agent (E) alone.

In addition there were added to each of compositions (a), (b), (c) and (d) 0.8 part by weight of a melamine formaldehyde resin, as an insolubilising agent, and 0.5 part by weight of calcium stearate. There was also added to each of the cationic compositions (a) and (b) 0.2 part by weight of sodium bicarbonate to catalyse the cross linking reaction of the cationic latex.

Each paper coating composition was diluted with water to give a high-shear viscosity as measured by a Ferranti-Shirley Viscometer at a shear rate of 12,800 $s^{-1}$ in the range 60–70 mPa.s if possible. The high-shear viscosities and the percentage by weight of solids in the diluted compositions are set forth in Table II below.

Each composition was coated on to a lightweight offset base paper of substance weight 48 $g.m^{-2}$ by means of a laboratory paper coating machine of the type described in British Patent Specification No. 1032536. The coated paper samples were then supercalendered under a pressure of 1000 psi (6.89 MPa) and a temperature of 65° C. with 10 passes through the nip of the calender rolls at a speed of 36 $m.min^{-1}$.

Each sample of calendered, coated paper was tested for gloss by the TAPPI Standard method, for smoothness by the Parker Print Surf at 10Kgf., for percentage reflectance to light of wavelength 457 nm and for percentage opacity. In each case the determinations of gloss, smoothness, % reflectance and % opacity were obtained by coating samples of paper at a range of different coat weights, measuring these quantities for each coat weight, plotting a graph of the quantity against coat weight and interpolating to find the value of quantity for a coat weight of 8 $g.m^{-2}$. The results are set forth in Table II below:

TABLE II

| Composition | % by wt. of dry solids | High shear viscosity (mPa.s) | Gloss (TAPPI units) | Smoothness | % reflectance to light of 457 nm. wavelength | % opacity |
|---|---|---|---|---|---|---|
| (a) | 62.0 | 62 | 45 | 0.72 | 78.1 | 90.1 |
| (b) (i) | 60.6 | 66 | 45 | 1.05 | 78.4 | 90.4 |
| (b) (ii) | 61.2 | 70 | 43 | 0.68 | 78.4 | 89.8 |
| (b) (iii) | 59.4 | 72 | 38 | 0.71 | 78.4 | 90.1 |
| (c) | 65.8 | 73 | 46 | 0.67 | 78.1 | 90.1 |
| (d) | 64.9 | 104 | 39 | 0.76 | 77.8 | 89.7 |

When the results for cationic composition (a) are compared with those for the corresponding anionic composition (c), and the results for the cationic compositions of type (b) are compared with those for the corresponding anionic composition (d), it will be noted that the coated paper properties for a cationic system in accordance with the invention are broadly similar to those obtained with a conventional anionic system.

Samples of paper coated with the above coating compositions were used as recycled paper or "broke" in a paper making process. Bleached sulphite pulp was beaten in accordance with TAPPI Standard T200 to a degree of freeness of 45 SR or 270 Canadian Standard Freeness and paper making compositions were prepared consisting of suspensions in water of the following ingredients:

| Ingredient | Parts of weight |
|---|---|
| Bleached sulphite pulp | 70 |
| Broke fibre | 30 |
| Calcium carbonate filler | 50 |
| Polyacrylamide retention aid | 0.03 |

The calcium carbonate filler had a particle size distribution such that 43% by weight consisted of particles having an equivalent spherical diameter smaller than 2 microns. Since the broke contained about 20% by weight of inorganic filler material the quantity of fresh calcium carbonate filler added was reduced to give a total quantity of filler of 50 parts by weight. Similarly the weight of dry broke added (fibre+filler) was such as to provide 30 parts by weight of fibre.

The retention of the calcium carbonate filler in paper prepared from compositions containing broke which had been coated with each of the coating compositions (a), (b)(ii), (c) and (d) above was measured by means a retention jar with the stirrer set at speed 5 (1050 rpm) and a stirring duration of 30 seconds. As a comparison the retention of the same calcium carbonate filler in a paper making composition containing no broke was also measured. The results are set forth in Table III below:

TABLE III

| Broke containing coating composition | % by wt. retention of calcium carbonate |
|---|---|
| None | 74.3 |
| (a) | 83.9 |
| (b) (ii) | 79.2 |
| (c) | 49.8 |
| (d) | 46.2 |

These results show that although the incorporation into paper making composition of broke which has been coated with an anionic composition (c) and (d) reduces the retention of a calcium carbonate filler as compared with a paper making composition which contains no broke, the incorporation of broke coated with a. cationic composition actually improves the retention of the filler.

EXAMPLE 3

A batch of raw crushed marble was ground by the method described in Example 1 above to give a ground product having a particle size distribution such that 60% by weight consisted of particles having an equivalent spherical diameter smaller then 2 microns. The suspension of ground marble was dewatered by means of a centrifuge and the centrifuge cake which contained 68% by weight of dry solids was used in the following experiments.

Samples of the centrifuge cake of ground marble were mixed first with an anionic dispersing agent, and then, after thorough mixing, with a cationic dispersing agent. In each case a predetermined quantity of the anionic dispersing agent was used, but, for the cationic dispersing agent, a small quantity of the dispersing agent was first added, the suspension was vigorously mixed for 1 minute, and the viscosity of the suspension was measured by means of a Brookfield Viscometer at a spindle speed of 100 rpm. The amount of dispersing agent and the viscosity were recorded and a further small quantity of the dispersing agent was added and the procedure repeated. Further small increments of the dispersing agent were added until the viscosity of the suspension reached a minimum, at which point the total amount of the cationic dispersing agent which had been added was regarded as the optimum.

The dispersing agents were:

(G) an anionic polyelectrolyte which was a sodium polyacrylate having a number average molecular weight of 70,000

(H) sodium silicate which is a sodium salt of a polysilicic acid and acts as an anionic dispersing agent;

(I) a cationic polyelectrolyte which was a poly (diallyl dimethyl ammonium chloride) having a number average molecular weight of 50,000.

(J) a cationic polyelectrolyte which was a polyethyleneimine.

When dispersing agent (J) was used it was also necessary to add sufficient sulphuric acid to adjust the pH to 7.8 since polyethyleneimines are sensitive to pH and do not act efficiently as dispersing agents at pH values greater than 8.

As a comparison one sample of the centrifuge cake was treated with dispersing agent (J) at pH 7.8 alone, no anionic dispersing agent being used.

For each combination of dispersing agents the percentage by weight of dry marble in the suspension, the minimum viscosity of the suspension and the quantities of anionic and cationic dispersing agent were recorded, and the results are set forth in Table IV below:

TABLE IV

| Anionic dispersing agent | Amount used (% by wt.) | Cationic dispersing agent | Amount used (% by wt.) | % by wt. of dry solids | Minimum viscosity (mPa.s) |
|---|---|---|---|---|---|
| G | 0.10 | I | 0.48 | 67.2 | 3000 |
| G | 0.10 | J | 0.40 | 67.5 | 252 |
| H | 0.16 | J | 0.39 | 65.4 | 224 |
| none | — | J | 0.37 | 67.1 | >10,000 |

These results show that, in general, lower viscosities are obtainable with polyethyleneimine as the cationic dispersing agent, rather than with poly (diallyl dimethyl ammonium chloride), but the use of the cationic dispersing agent must be preceded by the addition of an anionic dispersing agent.

EXAMPLE 4

A batch of marble flour having a particle size distribution such that substantially all of the particles passed through a No. 300 mesh British Standard sieve (nominal aperture 53 microns) was subjected to attrition grinding in a concentrated, deflocculated aqueous suspension, the quantities of marble flour, water and grinding sand being:

615 g marble flour 330 g water+anionic and cationic dispersing agents 1500 g sand The grain size of the sand was smaller than No. 18 mesh British Standard sieve (nominal aperture 0.850 mm) and larger than No. 30 mesh British Standard sieve (nominal aperture 0.500 mm). The anionic dispersing agent used was (E) and the cationic dispersing agent was (F), both as described in Example 1 above. Portions of marble flour were ground using different total quantities of (E) and (F) but in each case the weight ratio of (F):(E) was 4:1. In each case the grinding was continued for a time sufficient to dissipate in the suspension 396kJ of energy per kg of dry marble and in each case the product had a particle size distribution such that about 50% by weight consisted of particles having an equivalent spherical diameter smaller than 2 microns. On completion of grinding the suspension of ground marble was separated from the sand and the viscosity of the suspension was measured by means of a Brookfield Viscometer at a spindle speed of 100 rpm. The suspension was then diluted with a small quantity of water and the viscosity was measured again. The percentage by weight of dry marble in the suspension was also determined by drying a known small weight of the suspension and weighing the dried residue. The steps of diluting with water and measuring the viscosity and percentage by weight of dry marble were repeated several times. A graph was drawn of viscosity against percentage by weight of dry marble and the percentage by weight of dry marble in the suspension which had a viscosity of 500 mPa.s was found by interpolation. The results are set forth in Table V below:

TABLE V

| % by wt. of (E) | % by wt. of (F) | Total % by wt. of dispersing agents | % by wt. of dry marble for a viscosity of 500 mPa.s |
|---|---|---|---|
| 0.05 | 0.20 | 0.25 | 63.9 |
| 0.06 | 0.24 | 0.30 | 64.5 |

TABLE V-continued

| % by wt. of (E) | % by wt. of (F) | Total % by wt. of dispersing agents | % by wt. of dry marble for a viscosity of 500 mPa.s |
|---|---|---|---|
| 0.07 | 0.28 | 0.35 | 65.0 |

EXAMPLE 5

Further batches of the same marble flour as was used in Example 4 were ground by the method described in Example 4, there being used as the anionic dispersing agent 0.07% by weight, based on the weight of dry marble, of (E), and as the cationic dispersing agent 0.28% by weight, based on the weight of dry marble, of one of a selection of poly (diallyl dimethyl ammonium chloride) polyelectrolytes of different molecular weights. In each case the percentage by weight of dry marble in a suspension having a viscosity of 500 mPa.s was measured as described in Example 4 above and the results are set forth in Table VI below:

TABLE VI

| Number average molecular weight of cationic dispersing agent | % by wt. of dry marble for a viscosity of 500 mPa.s |
|---|---|
| 9,500 | 58.4 |
| 26,000 | 61.8 |
| 50,000 | 65.0 |
| 71,500 | 64.9 |

These results show that the poly (diallyl dimethyl ammonium chloride) should have a number average molecular weight of at least 50,000 if a marble suspension of acceptable fluidity is to be obtained.

EXAMPLE 6

A batch of raw crushed marble was ground by the method described in Example 1 to give a ground product having a particle size distribution such that 60% by weight consisted of particles having an equivalent spherical diameter smaller than 2 microns. The suspension of ground marble was dewatered by means of centrifuge and the centrifuge cake which contained 73% by weight of dry solids was used in the following experiments:

Samples of the ground marble centrifuge cake were first mixed with 0.1% by weight, based on the weight of dry marble, of anionic dispersing agent G as described in Example 3 (i.e. a sodium polyacrylate having a number average molecular weight of 70,000). After thorough mixing there was added to each sample of aqueous suspension of anionically dispersed ground marble a quantity of one of the four following cationic dispersing agents:

(I) a cationic polyelectrolyte which was a poly(diallyl dimethyl ammonium chloride) having a number average molecular weight of 50,000–100,000;

(J) a cationic polyelectrolyte which was a polyethyleimine;

(K) a polyethyleneimine of number average molecular weight lower than that of (J);

(L) a polyethyleneimine of number average molecular weight lower than that of (K).

The quantity of each cationic dispersing agent was that which was found by experiment to give the lowest viscosity for a suspension of given solids content. For dispersing agent (I) this quantity was found to be 0.45% by weight, based on the weight of dry marble, and for dispersing agents (J), (K) and (L) the quantity was found to be 0.40% by weight, based on the weight of dry marble.

In the case of the polyethyleneimine dispersing agents (J), (K) and (L) there was also added sufficient sulphuric acid to adjust the pH to 7.8. In each case the viscosity of the suspension was measured by means of a Brookfield Viscometer at a spindle speed of 100 rpm and the percentage by weight of dry solids in the suspension was determined by completely drying a known weight of the suspension and weighing the dried residue. The suspension was then diluted with a small quantity of water and further determinations of viscosity and percentage by weight of dry solids were made. The procedure of diluting the suspension and measuring the viscosity and percentage by weight of dry solids was repeated two or three times and a graph was plotted of viscosity against percentage by weight of dry solids. The solids concentration for a suspension having a viscosity of 300 mPa.s was determined by interplotation and the results are set forth in Table VII:

TABLE VII

| Cationic dispersing agent | % by weight of dry marble for a viscosity of 300 mPa.s |
|---|---|
| I | 61.0 |
| J | 68.5 |
| K | 71.8 |
| L | 73.0 |

EXAMPLE 7

A batch of raw crushed marble was ground in an aqueous suspension containing 30% by weight of dry solids and in the absence of chemical dispersing agent, by means of a particulate grinding medium to yield a ground calcium carbonate product of paper coating grade having a particle size distribution such that 90% by weight of the particles had an equivalent spherical diameter smaller than 2 microns. The suspension of ground marble was dewatered by filtration in the absence of a flocculating agent and the filter cake was dried and pulverised in a laboratory hammer mill.

Samples of the finely ground marble powder were mixed with water to form a suspension containing 60% by weight of dry solids and varying quantities of an anionic and of a cationic dispersing agent. The anionic dispersing agent was a sodium polyacrylate dispersing agent having a number average molecular weight of 4000 and the cationic dispersing agent was a poly (diallyl dimethyl ammonium chloride) having a number average molecular weight of about 50,000.

In each experiment the anionic dispersing agent was added first to the suspension of ground marble and the mixture stirred by 9,400 revolutions of an impeller rotating at 1,420 rpm. The cationic dispersing agent was then added and the mixing procedure was repeated. The viscosity was measured immediately on completion of the second mixing procedure by means of a Brookfield Viscometer.

The results obtained are set forth in Table VIII below:

TABLE VIII

| Total % by wt. of mixed dispersing agents | % by wt. of anionic dispersing agent | % by wt. of cationic dispersing agent | Wt. ratio cationic: anionic | Viscosity (mPa.s) |
|---|---|---|---|---|
| 0.416 | 0.053 | 0.363 | 6.9 | 10,000 |
| 0.642 | 0.082 | 0.560 | 6.9 | 4,600 |
| 0.850 | 0.108 | 0.742 | 6.9 | 106 |
| 1.03 | 0.131 | 0.899 | 6.9 | 82 |
| 1.29 | 0.164 | 1.13 | 6.9 | 78 |
| 2.07 | 0.263 | 1.81 | 6.9 | 480 |
| 0.348 | 0.070 | 0.278 | 4.0 | 9,400 |
| 0.504 | 0.101 | 0.403 | 4.0 | 3,600 |
| 0.616 | 0.123 | 0.493 | 4.0 | 60 |
| 0.800 | 0.160 | 0.640 | 4.0 | 74 |
| 1.02 | 0.204 | 0.816 | 4.0 | 576 |
| 1.28 | 0.256 | 1.02 | 4.0 | 2,400 |
| 0.364 | 0.102 | 0.262 | 2.6 | 3,600 |
| 0.570 | 0.159 | 0.411 | 2.6 | 1,800 |
| 0.732 | 0.205 | 0.527 | 2.6 | 3,400 |
| 0.910 | 0.254 | 0.656 | 2.6 | 4,350 |
| 1.05 | 0.294 | 0.756 | 2.6 | 4,650 |
| 1.60 | 0.447 | 1.15 | 2.6 | 4,150 |
| 0.145 | 0.053 | 0.092 | 1.7 | 10,000 |
| 0.273 | 0.100 | 0.173 | 1.7 | 6,150 |
| 0.351 | 0.129 | 0.222 | 1.7 | 3,360 |
| 0.434 | 0.160 | 0.274 | 1.7 | 7,600 |
| 0.541 | 0.199 | 0.342 | 1.7 | 7,900 |
| 0.790 | 0.291 | 0.499 | 1.7 | 5,900 |
| 1.26 | 0.464 | 0.796 | 1.7 | 6,000 |

These results show that the optimum dispersion was obtained when the ratio of the weight of cationic dispersing agent to the weight of anionic dispersing agent was about 4:1. When the ratio was increased to 6.9:1 it was still possible to obtain a very fluid suspension but at the expense of a slightly higher dose of mixed dispersing agents.

EXAMPLE 8

A batch of raw crushed marble was ground in an aqueous suspension containing 30% of dry solids and in the absence of chemical dispersing agents by means of a particulate grinding medium to yield a ground product having a particle size distribution such that 78% by weight of the particles had an equivalent spherical diameter smaller than 2 microns. The suspension of ground marble was dewatered in the absence of a flocculating agent on a vacuum drum filter to a dry solids content of 64% by weight. Some of the filter cake thus formed was thermally dried and mixed back with the moist filter cake to give a mixture having a dry solids content of 70% by weight.

This mixture was divided into three portions to be treated with cationic poly(diallyl dimethyl ammonium chloride) dispersing agents having three different number average molecular weights. Each of the three portions were further subdivided into three smaller portions which were treated with different doses of anionic dispersing agent (E) as described in Example 1.

In each case the anionic dispersing agent was added first to the cake of ground marble and well mixed therewith, and the cationic dispersing agent was then added and mixed in. The dose of the cationic dispersing agent used was in each case about 3.5 times the dose of the anionic dispersing agent.

In each case the viscosity of the resultant suspension was measured by means of a Brookfield Viscometer at a spindle speed of 100 rpm and the percentage by weight of dry solids was determined by completely drying a known weight of the suspension and weighing the dried residue. The suspension was then diluted with a small quantity of water and further determinations of viscosity and percentage by weight of dry solids were made. A graph was plotted of viscosity against percentage by weight of dry solids and the solids content for a suspension having a viscosity of 300 mPa.s was determined by interpolation.

The results obtained are set forth in Table IX below:

TABLE IX

| Mol. wt. of cationic dispersing agent | % by wt. of anionic dispersing agent | % by wt. of cationic dispersing agent | % by wt. of dry solids of a viscosity of 300 mPa.s |
|---|---|---|---|
| 100,000 | 0.080 | 0.265 | 64.1 |
| 100,000 | 0.108 | 0.370 | 65.4 |
| 100,000 | 0.124 | 0.450 | 64.7 |
| 200,000 | 0.074 | 0.260 | 64.7 |
| 200,000 | 0.100 | 0.360 | 68.1 |
| 200,000 | 0.125 | 0.450 | 67.1 |
| 500,000 | 0.075 | 0.260 | 67.9 |
| 500,000 | 0.100 | 0.360 | 68.4 |
| 500,000 | 0.125 | 0.450 | 67.6 |

The results show that slightly more fluid suspensions for a given solids content were obtained when the cationic dispersing agent having a number average molecular weight of 500,000 was used.

We claim:

1. An aqueous paper coating composition which comprises (i) at least 45% by weight of a particulate inorganic pigment and (ii) an adhesive; wherein the said pigment is cationically dispersed with a dispersing agent comprising an anionic polyelectrolyte and a cationic polyelectrolyte, the cationic polyelectrolyte being present in an amount sufficient to render the pigment particles cationic; wherein the adhesive is a cationic or nonionic adhesive; and wherein the particulate pigment is one which is not capable of being dispersed in water at high solids, and following vigorous mixing, in the sole presence of said cationic polyelectrolyte.

2. A paper coating composition according to claim 1, wherein the pigment is selected from calcium carbonate, calcium sulphate, talc or a calcined kaolin clay.

3. A paper coating composition according to claim 1, wherein the pigment is a calcium carbonate pigment.

4. A paper coating composition according to claim 1, wherein the number average molecular weight of the anionic polyelectrolyte is in the range of from 500 to 100,000.

5. A paper coating composition according to. claim 1, wherein the anionic polyelectrolyte is employed in an amount in the range of from 0.01% to 0.5% by Weight based on the weight of dry pigment.

6. A paper coating composition according to claim 1, wherein the cationic polyelectrolyte is a water-soluble substituted polyolefin containing quaternary ammonium groups.

7. A paper coating composition according to claim 6, wherein the number average molecular weight of the substituted polyolefin is in the range of from 1500 to 1,000,000.

8. A paper coating composition according to claim 6 or 7, wherein the amount of cationic polyelectrolyte employed is in the range of from 0.01% to 1.5% by weight based on the weight of dry pigment.

9. A paper coating composition according to claim 1, wherein the cationic polyelectrolyte is a water-soluble organic compound having a plurality of basic groups and a number average molecular weight in the range of from 10.000 to 1,000,000.

10. A paper coating composition according to claim 9, wherein the organic compound is polyethyleneimine having a number average molecular weight in the range of from 50,000 to 1,000,000.

11. A paper coating composition according to claim 1, wherein the ratio of the weight of cationic polyeleotrolyte to the weight of anionic polyelectrolyte is in the range of from 2:1 to 20:1.

12. An aqueous paper coating composition according to claim 1, wherein the inorganic pigment has a particle size distribution such that at least 50% by weight has an equivalent spherical diameter smaller than 2 μm.

13. A process for preparing a paper coating composition comprising the steps of:

(i) dispersing in aqueous suspension a particulate inorganic pigment; and (ii) combining the dispersed aqueous suspension with an adhesive and, if necessary, adjusting the aqueous suspension such that the particulate inorganic pigment constitutes at least 45% by weight of the composition;

wherein the pigment is cationically dispersed using a dispersing agent comprising a combination of an anionic polyelectrolyte and a cationic polyelectrolyte; wherein the cationic polyelectrolyte is used in an amount sufficient to render the pigment particles cationic; wherein the adhesive is a cationic or non-ionic adhesive; and wherein the particulate inorganic pigment is one which is not capable of being dispersed in water at high solids, and following vigorous mixing, in the sole presence of said cationic polyelectrolyte.

14. A process according to claim 13, wherein the pigment is selected from calcium carbonate, calcium sulphate, talc or calcined kaolin clay.

15. A process according to claim 14, wherein the pigment is a calcium carbonate pigment.

16. A process according to claim 13, wherein the pigment is mixed with the anionic polyelectrolyte before mixing with the cationic polyelectrolyte.

17. A process according to claim 13, wherein the inorganic pigment has a particle size distribution such that at least 50% by weight has an equivalent spherical diameter smaller than 2 μm.

18. An aqueous paper coating composition which comprises (i) at least 45% by weight of a particulate inorganic paper coating pigment having a particle size distribution such that at least 50% by weight has an equivalent spherical diameter smaller than 2 μm and (ii) an adhesive; wherein the said pigment is cationically dispersed with a dispersing agent comprising an anionic polyelectrolyte and a cationic polyelectrolyte, the cationic polyelectrolyte being present in an amount sufficient to render the pigment particles cationic; wherein the adhesive is a cationic or non-ionic adhesive; and wherein the particulate pigment is selected from calcium carbonate, calcium sulphate, talc and a calcined kaolin clay.

19. A process for preparing a paper coating composition comprising the steps of:

(i) dispersing in aqueous suspension a particulate inorganic paper coating pigment having a particle size distribution such that at least 50% by weight has an equivalent spherical diameter smaller than 2 μm; and (ii) combining the dispersed aqueous suspension with an adhesive and, if necessary, adjusting the aqueous suspension such that the particulate inorganic pigment constitutes at least 45% by weight of the composition;

wherein the pigment is cationically dispersed using a dispersing agent comprising a combination of an anionic polyelectrolyte and a cationic polyelectrolyte; wherein the cationic polyelectrolyte is used in an amount sufficient to render the pigment particles cationic; wherein the adhesive is a cationic or non-ionic adhesive; and wherein the particulate pigment is selected from calcium carbonate, calcium sulphate, talc and calcined kaolin clay.

* * * * *